United States Patent [19]

Kizawa

[11] Patent Number: 4,702,616

[45] Date of Patent: Oct. 27, 1987

[54] CLOCK

[75] Inventor: Hiroyuki Kizawa, Tokyo, Japan

[73] Assignee: Seikosha Co., Ltd., Tokyo, Japan

[21] Appl. No.: 876,372

[22] Filed: Jun. 19, 1986

[30] Foreign Application Priority Data

Jun. 19, 1985 [JP] Japan ..... 60-92486[U]
Jun. 19, 1985 [JP] Japan ..... 60-92488[U]

[51] Int. Cl.[4] ..... G04B 19/00; G04B 19/06

[52] U.S. Cl. ..... 368/223; 368/228; 368/236

[58] Field of Search ..... 368/76, 80, 88, 276, 368/285, 223–238, 314, 309

[56] References Cited

U.S. PATENT DOCUMENTS 1,903,003 3/1933 Mansfield ..... 368/236
2,566,741 9/1951 Newhouse ..... 368/285
4,437,770 3/1984 Gogniat ..... 368/232

FOREIGN PATENT DOCUMENTS 335155 1/1956 Switzerland ..... 368/236

*Primary Examiner*—Vit W. Miska
*Attorney, Agent, or Firm*—Bruce L. Adams; Van C. Wilks

[57] ABSTRACT

A clock has a timepiece movement and a dial disposed on the front face of a base plate. A transparent cover plate having front and back faces is spaced apart from the dial to define a space between the back face of the cover plate and the front face of the dial. Decorations are fixed to the peripheral portion of the front face of the cover plate to define time reference members, and a clock hand is disposed in the space and driven by the timepiece movement to move relative to the time reference members to indicate time. Protrusions extend downwardly from the decorations through the cover plate toward the front face of the dial such that the protrusions are contactable with the front face of the dial upon deformation of the dial and the cover plate to maintain a sufficient space therebetween to allow free movement of the hand.

11 Claims, 5 Drawing Figures

CLOCK

BACKGROUND OF THE INVENTION

The present invention relates to a clock such as a hanging clock, or the like, and particularly relates to a thin clock.

A clock is well known which is provided with an install plate used also as a back frame, a movement capable fixedly attached on a back surface of the install plate, a dial disposed in front of the install plate, a transparent front cover fixedly attached to the install plate in front of the dial, and hands disposed between the front cover and the dial and driven by a timepiece movement. A setting shaft for correcting time is disposed on the back side of the install plate.

Recently, a clock has been much desired to be light, thin and small, so that it has been an extremely important technical problem to make the clock thin. Under such the circumstances, a distance between the dial and the front cover is made extremely narrow, and, further, the front cover, the dial, the install plate, and even the hands per se have been formed extremely thin to the extent that the strength of the clock is adversely affected.

As the result, the install plate and the front cover have come to be easily deformed due to change of temperature, due to pressure applied to the clock during turning of the hands, and so on, so as to generate a phenomenon that the front cover touches the hands, especially, a minute hand, so that the minute hand becomes removed from a minute hand shaft to thereby stop, or the front cover is rubbed and becomes damaged by the minute hand, or, in the worst case, the clock stops completely.

SUMMARY OF THE INVENTION

An object of the present invention is therefore to provide a clock in which the gap between the front cover and dial can be kept fixed even if the install plate of the movement capsule or the front cover is made to be deformed.

The present invention is featured in that decorations are fixedly attached on a front surface of a front cover in an exposed state, and that fixing means for fixedly attaching the decorations from a back surface of a dial or legs integrally formed with the decorations so as to pass through the front cover is made to come to close to or to abut against a front surface of the dial.

DETAILED DESCRIPTION OF PREFERRED EMBODIMENTS

Figure 1:
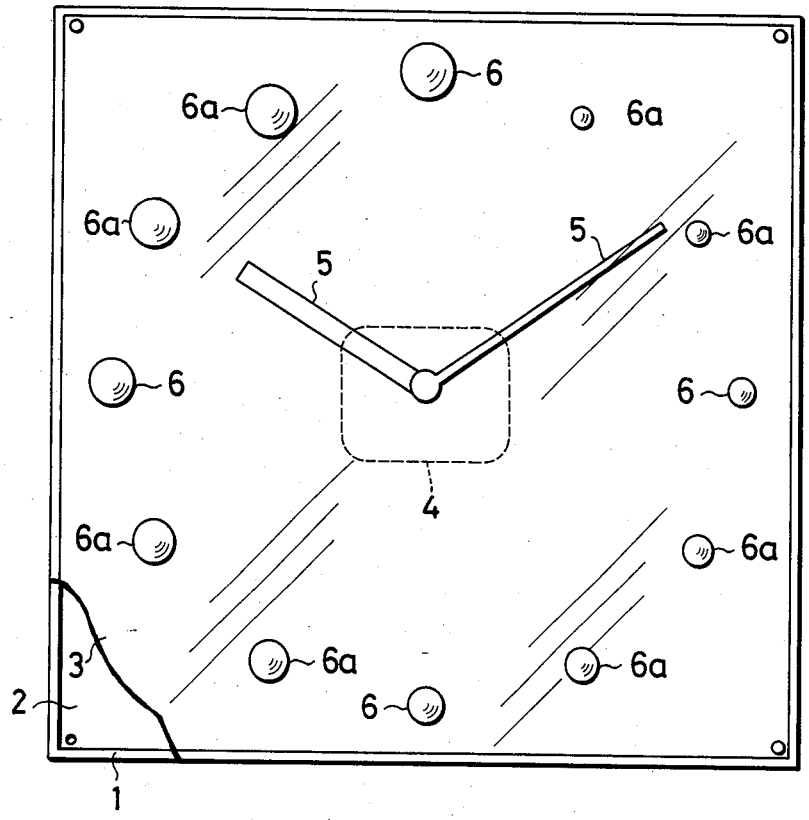
FIG. 1 is a front view of a clock to which the present invention is applied.

Referring to the drawings, preferred embodiments according to the present invention will be described.

Figure 2:
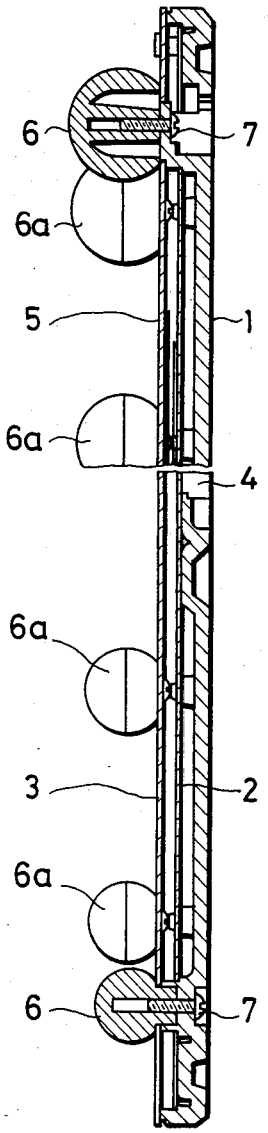
FIG. 2 is a partially cut-away enlarged cross-section of the clock.

As shown in FIGS. 1 and 2, a thin clock according to the present invention is constituted by an install or base plate 1 used also as a back frame, a dial 2, a transparent front cover plate 3, and a movement capsule 4. Hands 5 driven by a well-known timepiece movement (not-shown) provided in the capsule 4 are disposed in a gap or space between the dial 2 and the front cover 3.

Decorations 6 and **6*a* used as time reference members are fixedly attached on the periphery of the front surface of the front cover 3. Among the decorations 6 and 6*a*, the decorations 6 disposed at positions of twelve, three, six, and nine o'clock are attached to the front cover 3 by screws 7 screwed into the decorations 6 from the back surface of the install plate 1 through the dial 2 disposed between the front cover 3 and the install plate 1**.

Figure 3:
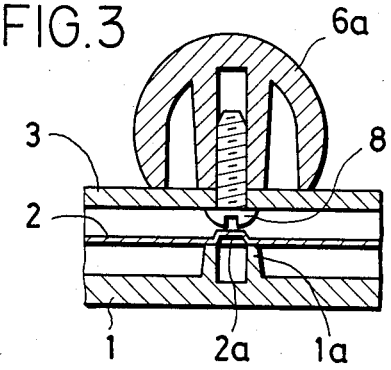
FIG. 3 is an enlarged cross-section of a main part of the clock.

The other decorations **6*a* are fixed to the front cover 3 by screws 8, by way of mere example of fixing means, which are screwed in the decorations 6*a* from the back surface of the front cover, as shown in FIG. 3. Further, projections 2*a* are integrally formed on the dial 2 at positions opposing to the heads of the screws 8 to be close to or abut on the heads of the screws 8. Supports 1*a* are integrally formed on the install plate 1, such that the tip end surfaces of the supports 1*a* abut on the back surface of the dial 2 at positions adjacent to the projections 2*a* as shown in FIG. 3. According to this arrangement, even if the install plate 1 and the front cover 3 are subject to deformation forces caused by application of an external force, the projections 2*a* of the dial 2 abut on the heads of the screws 8 fixing the decorations 6*a* onto the front cover to thereby prevent the deformation so that the gap or interval between the front cover 3 and the dial 2 can be kept constant and the front cover 3 is prevented from touching the hands 5**.

Figure 4:
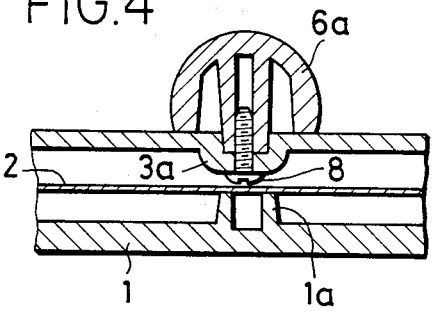
FIG. 4 is an enlarged cross-section of a main part of another embodiment.

Although the respective projection **2*a* is projected from the dial 2 to ensure abutment onto the screw 8, the shape of the projection is not limited to this particular one but rather depends on the size of the screw 8. For example, if a decoration attaching portion 3*a* of the front cover 3 is projected backwards as shown in FIG. 4, the dial 2** may be a simple flat plate.

Figure 5:
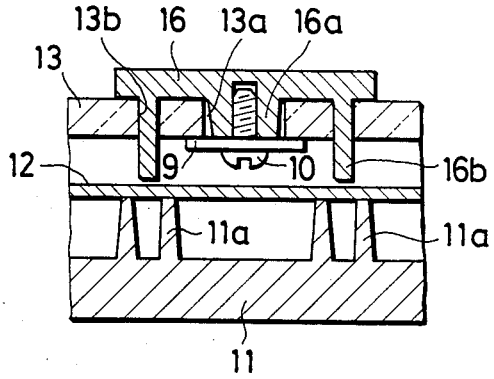
FIG. 5 is an enlarged cross-section of a main part of still another embodiment.

FIG. 5 shows another embodiment in which each decoration 16 is integrally formed at a central portion of its lower surface with a projection **16*a* having substantially the same height as the thickness of a front cover 13. A female screw portion is formed in the respective projection 16*a* at its lower end central portion. The respective decoration 16 is integrally formed on its lower surface with leg portions or protrusions 16*b* and 16*b*. The projection 16*a* of the respective decoration 16 is inserted into a through hole 13*a* bored in the front cover 13 and the leg portions 16*b* and 16*b* are passed through through-holes 13*b* and 13*b*. A screw 10 is screwed into the projection 16*a* through a bush 9 from the back surface of the front cover 13, so as to attach the decoration 16 to the front cover 13. The respective lower end surfaces of the leg portions 16*b* and 16*b* are made to be close to the front surface of a dial 2, or, alternatively they may, of course, be made to abut on the latter. In this arrangement, similarly to the above-mentioned embodiment, a gap between the front cover 13 and a dial 12 can be kept constant. Supports 11*a* and 11*a* are integrally formed on an install plate 11 on its front surface and receive the back surface of the dial 12 with a positional relation opposing to the leg portions 16*b* and 16*b* of the decoration 16. Therefore, even if the front cover 13 is subject to be excessively deformed, the deformation is prevented by the suppots 11***a* and 11*a* through the dial 12.

Although the decorations 6 and 6*a* may be any shape representing graduation numerals, such as Roman numerals, Arabic numerals, etc., it is desirable to take the design thereof into consideration.

According to the thus arranged present invention, even if the front cover is subject to deformation due to temperature changes, external forces, or the like, the means for fixing the decoration or the decoration leg portions abuts against the dial to keep the gap between the front cover and the dial constant so as to prevent the front cover from touching the hands, to thereby prevent faults such as injury of the front cover due to touching by the hands, stopping of rotation of the hands, stopping of operation of the clock, and so on. Further, being provided at positions representing time, the decorations may be used as time reference members and can give effects in design as solid letters.

What is claimed is:

1. In a clock having a capsule in which a timepiece movement is incorporated, an install plate on which said capsule is fixedly attached, a dial disposed in front of said install plate, a transparent front cover disposed in front of said dial, and hands disposed in a gap between said front cover and said dial and driven by said movement, the improvement comprising: decorations fixedly attached on a front surface of said front cover in an exposed state and disposed on a peripheral portion of the front cover to define a time reference member such that the hands rotate relative to the time reference member to indicate time; and means extending downwardly from the decorations through said front cover to contact with a front surface of said dial upon deformation of the dial and the front cover.

2. A clock according to claim 1; including supports integrally formed on said install plate for supporting the dial at a back surface thereof.

3. A clock according to claim 1; wherein the means extending downwardly comprises fixing means for fixing the decorations to the front cover.

4. A clock according to claim 1; wherein the means extending downwardly comprises legs integrally formed on the decorations.

5. A clock comprising: a base plate having a front face; a timepiece movement disposed on the front face of the base plate; a dial having front and back faces and being disposed on the front face of the base plate; a transparent cover plate having front and back faces and being spaced apart from the dial to define a space between the back face of the cover plate and the front face of the dial; decorations fixed to a peripheral portion of the front face of the cover plate to define time reference members; a clock hand disposed in the space and driven by the timepiece movement to move relative to the time reference members to indicate time; protrusions extending downwardly from the decorations through the cover plate toward the front face of the dial such that the protrusions are contactable with the front face of the dial upon deformation of the dial and the cover plate to maintain a sufficient space therebetween to allow free movement of the hand.

6. A clock according to claim 5; including fixing means for fixing the decorations to the front face of the cover plate.

7. A clock according to claim 6; wherein the fixing means comprises screws screwed from the back face of the cover plate into the decorations through the cover plate.

8. A clock according to claim 7; wherein the protrusions comprise head portions of the screws protruding downwardly from the back face of the cover plate.

9. A clock according to claim 5; wherein the protrusions comprise leg portions integrally formed with the decorations.

10. A clock according to claim 5; including supporting means extending upwardly from the front face of the base plate toward the back face of the dial in opposed relation to the protrusions for supporting the dial.

11. A clock according to claim 5; including projections disposed on the front face of the dial in opposed relation to the protrusions for receiving thereon the protrusions.

* * * * *